United States Patent [19]

Jacobsen

[11] 4,359,083

[45] Nov. 16, 1982

[54] APPARATUS FOR SEPARATING CASTINGS FROM MOULDS OF SAND OR SIMILAR MATERIAL

[75] Inventor: Ole A. Jacobsen, Copenhagen, Denmark

[73] Assignee: Dansk Industri Syndikat A/S, Herlev, Denmark

[21] Appl. No.: 203,904

[22] Filed: Nov. 4, 1980

[30] Foreign Application Priority Data

Nov. 15, 1979 [DK] Denmark ..... 4845/79

[51] Int. Cl.[3] ..... B22D 29/04

[52] U.S. Cl. ..... 164/404; 164/344

[58] Field of Search ..... 164/401, 402, 405, 404, 164/344–346, 131, 132; 414/225, 226, 751–753

[56] References Cited

U.S. PATENT DOCUMENTS 3,923,095 12/1978 Jorgensen et al. ..... 164/404

*Primary Examiner*—Gus T. Hampilos
*Assistant Examiner*—K. Y. Lin
*Attorney, Agent, or Firm*—Imirie & Smiley

[57] ABSTRACT

The invention concerns the technical problem of providing a simple and reliable apparatus for separating castings from moulds of sand or similar material at the end of a guiding track, on which the moulds with the enclosed castings are advanced step by step towards a knocking-out station. With a view hereto the apparatus comprises a number of possibly interchangeable claws equipped with vibrators which, when moved into the row of moulds, can penetrate the mould sand and be caused to enclose and pinch the outermost casting, whereafter the claws are shifted back to the initial position in which the pair of tongs formed by the claws can open in order to deliver the casting for further treatment. The claws can be specially formed so as to retain possible core sand in the castings.

6 Claims, 5 Drawing Figures

APPARATUS FOR SEPARATING CASTINGS FROM MOULDS OF SAND OR SIMILAR MATERIAL

FIELD OF THE INVENTION

The invention concerns an apparatus for separating castings from flaskless moulds of sand or similar material at the end of a guiding track which leads to a knocking-out station and on which the moulds together with the enclosed castings are advanced stepwise, the apparatus comprising, in known fashion, a number of extractors, which from a position of rest are movable such as to grasp the outermost casting in the row of moulds and are thereafter retractable to the position of rest, taking with them the casting mainly without adherent mould sand.

PRIOR ART BACKGROUND OF THE INVENTION

Apparatus of this type is known, for example from the specification of Danish Pat. No. 129,320 corresponding to e.g. British Pat. No. 1,440,154, German Pat. No. 2,432,382 and U.S. Pat. No. 3,923,095. In this case the extractors are rod-shaped magnets spring-biased towards a basic position in a common holder, in which position the front ends of the magnets are all in the same plane. The spring loading entails that all the magnets or at least a sufficient number thereof can come into contact with the surface of the casting facing the magnets and, when this has occurred, the magnets are locked together so that they all can contribute in drawing the casting from the mould and in carrying the casting in the course of its transport to a delivery position.

A condition in the use of this apparatus is that the casting is exposed in the free or open end of the mould, or the row of mould parts, and it is of course also a condition that the casting consists of a magnetizable material. The first of these conditions necessitates a certain complication in the design of the apparatus. It is certainly true that the outer mould part covering the casting to be removed can without particular difficulty be brought to fall down at the end of the guiding track, but it must at the same time be ensured that the casting remains in the following mould part, and for this purpose a separate holding mechanism is in many cases needed, for example, a latch which is thrown into mesh with the casting previous to removal of the outermost mould part. Also the magnets themselves and their control means, including means of locking and disengagement, increase rather considerably the costs and the complexity of the apparatus.

SUMMARY OF THE INVENTION

According to the invention, the apparatus differs from this known technique in that the extractors form a tool having at least two sets of claws equipped with vibrators and having such length and positions that on penetration into the mould sand surrounding the casting they can be made to enclose the casting, the sets of claws being then movable relative to each other into grasping contact with the casting.

ADVANTAGES AND PREFERRED DETAILS OF THE INVENTION

While a considerable number of magnets are required in the above mentioned known apparatus to ensure a sufficiently firm grip on the castings, in the case of the apparatus according to the invention only a few claws are required, usually only two claws per set or even only a single claw in each set, as the grasping of the casting during and after the extraction depends on a mechanical pinching of the casting between the claws. Another particular advantage of the apparatus according to the invention is that on account of the effect of the vibrators the claws may without much difficulty be pressed through a mould part covering the casting to be removed, so that the removal of the mould part in question does not require particular attention. Moreover, the apparatus may be of simple design, as the two sets of claws may appropriately be borne by their respective part of a two-piece holder, which is movable towards and away from the open end of the mould, and whose parts are movable in relation to each other by rotation on an axis transverse to the direction of displacement. The claws thus form in this case an instrument similar to a pair of tongs with vibrating jaws, which can be activated first to penetrate the sand mould and thereafter to pinch the casting tightly so that it is brought along in the retracting movement.

The claws can in many cases appropriately comprise interchangeable or adjustable, mainly parallel, chisel-like spears, each equipped with a vibrator. Such spears may be fairly slender, so that owing to the vibration they may relatively easily be pressed into the mould sand around the casting, and the interchangeability or adjustability has the object of enabling an easy adaptation of the apparatus from one type of castings to another.

A special problem occurs in the removal of cored castings, as importance is often here attached to avoiding the mixing of the mould sand with the core sand which is normally completely dead-burnt. By use of the apparatus according to the invention, the desired separation between these two types of sand can be obtained more or less automatically, when one or more of the claws are adapted to retain, in their grasping position, the core sand within the casting, e.g. by being formed like a spade with a blade for blocking one or more core holes in the casting. Provision is hereby made for the dead-burnt and thereby fast-running core sand to be retained in the casting until the separation of this casting from the mould sand, so that the core sand can be discharged and collected separately.

In automatic casting plants knocking-out of at least 300 castings per hour may be required, which corresponds to a rate of 12 sec. or less. Particularly when it is wished to subject the castings being knocked out to an extra treatment such as removal of adherent remains of mould sand by means of brushing, beating or shot-blasting without increasing this rate, the apparatus may appropriately have two or more tools of the kind referred to which are mounted on a common support for alternate removal of successive castings from the mould.

DETAILED DESCRIPTION OF THE PREFERRED EMBODIMENT

Figure 1:
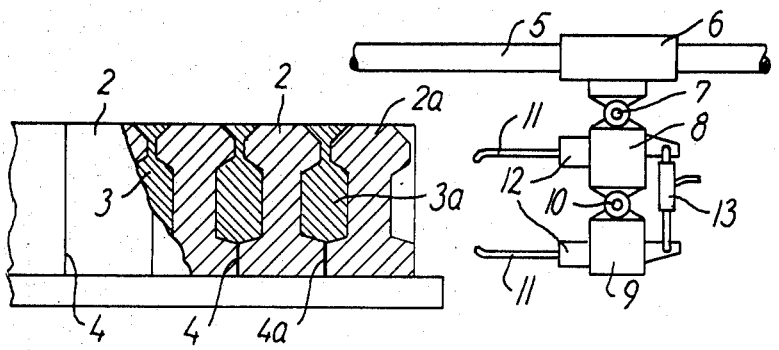
FIG. 1 shows a simplified side elevation of a preferred embodiment of the apparatus in its starting position at the end of a guiding track carrying a mould of the above mentioned kind, FIG. 2 a similar view of the same apparatus during an initial phase of the casting removal, FIG. 3 a corresponding view during a following phase of the same operation, the casting in this figure being shown however with a downwardly open core hole, FIG. 4 a spade-formed claw seen from above, and FIG. 5 a top plan view corresponding to FIG. 4, but with two removal tools.
Figure 2:
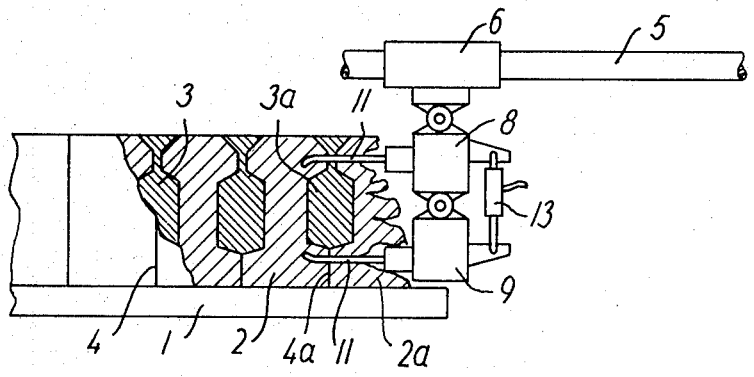
Figure 3:
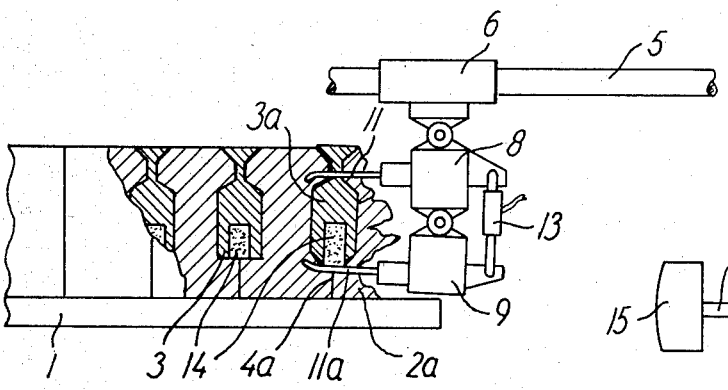

FIGS. 1–3 show the discharge end of a guiding track 1, which supports a mould consisting of a number of identical mould parts 2 with a casting 3 at each joint 4 of the mould. On a guide rail 5 parallel with the track 1 a movable carriage or slide 6 is suspended, which through a hinge 7 carries a holder consisting of two parts 8 and 9 connected with one another through a hinge 10, whose axis is at right angles to the guide rail 5. Each of the two holder parts 8 and 9 comprises one or more chisel-like spikes or spears 11 directed towards the open side of the outermost mould part 2*a*, the free ends of the spikes in the shown embodiment being curved slightly towards each other. The spikes or spears are equipped with vibrators 12, not shown in detail, for example electrically, hydraulically or pneumatically driven rotary vibrators. A hydraulic or pneumatic cylinder unit 13 is inserted between a pair of rearwardly pointing arms on the two holder parts 8 and 9 and is operative by lengthening and shortening to close and open the tongs formed by the elements 8, 11 and 9, 11 respectively.

In FIG. 1 it is presupposed that the outermost mould part 2*a* is intact, although it can show signs of heat damage on its uncovered front. When the extreme piece of casting 3*a* is to be removed, the slide or carriage 6 is shifted towards the left to the position shown in FIG. 2. In this position the spikes 11 have penetrated the outermost mould part 2*a* and have passed through the associated joint 4*a* so that the points curved towards each other are pushed slightly into the following mould part 2. It is evident that the points of the spikes may not hereby damage the casting 3*a* to be removed and, in order that the same apparatus may be used for different types of castings 3, the spikes 11 may, as mentioned, be interchangeable with spikes of another shape, or they may be adjustable in vertical and transverse direction on the two holder parts 8 and 9.

When the spikes have reached the position in FIG. 2, pressure fluid is admitted to the cylinder unit 13, which results in the lower holder part 9 tipping slightly in hinge 10 to the position shown in FIG. 3, in which the spikes have pinched the casting 3*a* and broken it partially free of the following mould part 2. Hereafter the carriage or slide 6 can be shifted back to the position in FIG. 1, thereby taking along the casting 3*a* which can be delivered for further treatment, whereafter the apparatus is ready for a new operation.

As indicated in FIGS. 2 and 3, the spikes 11 can cause a partial crushing of the outermost mould part 2*a*, and while the casting is being removed the fragments of the mould may drop down onto the conveyor for re-use, if required, after suitable regeneration. When the track 1 is in the form of a grate or grid, as known per se, the mould material can drop down through the spaces between the grid bars.

Figure 4:
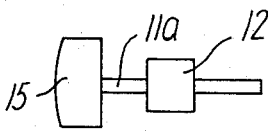

As stated in the foregoing, FIG. 3 shows castings 3 having one or more downwardly open cavities formed by corresponding cores 14. The dead-burnt sand of these cores should not be mixed with the mould sand forming the mould parts 2, and the lower claws 11*a* can therefore be adapted so as to retain the core sand in the castings until they have been separated from the mould sand. With a view thereto the claw or claws 11*a* can have the spade form shown in FIG. 4 with a blade 15 for covering the core hole at the bottom of the casting.

Figure 5:
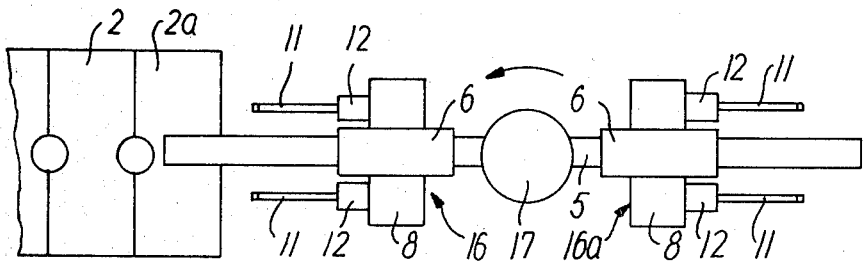

FIG. 5 shows the apparatus in accordance with the invention in an embodiment with greater capacity because it comprises two tools 16 and 16*a* which operate alternately to remove successive castings from the mould 2, 2*a*. Each of the tools has two upper and two lower chisel-like claws 11, only the upper of which are to be seen on the drawing, and both tools are movable on a common guide rail 5 which is suspended in a vertical revolving frame 17, which can be imparted an intermittent rotation as indicated by the arrow. In the shown position the left hand tool 16 is ready to remove a casting which is enclosed between the mould parts 2*a* and 2, while the right hand tool 16*a* has just delivered the previous piece of casting. In one or more intermediate positions, not shown, this piece of casting may have been cleared of adherent remains of mould sand, e.g. by brushing or shot-blasting, just as it may have been emptied of possible core sand and tested in various respects. In the case of such intermediate positions the number of tools should be increased so that in each intermediate or stop position of the frame a tool is to be found in the removal position.

The cleaning and testing of the castings can of course also be performed in a separate unit, for example, a revolving frame to which the castings are delivered by the extractor tool, so that the same is quickly ready for a further operation.

I claim:

1. An apparatus for separating castings from flaskless moulds of sand or similar material located at the end of a guide track which is used for guiding the intermittent advance of said flaskless moulds with its enclosed castings to a knocking-out station, comprising a number of extractors located at the vicinity of said guide track which are movable from a position of rest to a grasping position relative to the outermost casting in the row of said flaskless moulds and are thereafter retractable to the position of rest taking with them the casting mainly without adherent mould sand, wherein the extractors form a tool having at least two sets of claws equipped with vibrators and having such length and positions that on penetration into the mould sand surrounding the casting they can be caused to enclose the casting, wherein at least one of said claws is movable relative to the other for grasping contact with the casting.

2. Apparatus according to claim 1, wherein the two sets of claws are borne by their respective part of a two-piece holder, which is movable towards and away from the open end of the mould, and whose parts are movable in relation to each other by rotation on an axis transverse to the direction of displacement.

3. Apparatus according to claim 1, wherein the claws comprise interchangeable or adjustable, mainly parallel, chisel-like spears each equipped with a vibrator.

4. Apparatus according to claim 1 for removal of cored castings, wherein at least one of the claws is shaped so as to retain the core sand in the casting in its grasping position.

5. Apparatus according to claim 4, wherein at least one of the claws is shaped like a spade with a blade for blocking one or more core holes in the casting.

6. Apparatus according to claim 1, wherein two or more tools of the kind referred to are mounted on a common support for alternate removal of successive castings from the mould.

* * * * *